US005314351A

United States Patent [19]

Yamamoto

[11] Patent Number: 5,314,351

[45] Date of Patent: May 24, 1994

[54] PRESSURE CONNECTION TERMINAL

[75] Inventor: Masaya Yamamoto, Shizuoka, Japan

[73] Assignee: Yazaki Corporation, Japan

[21] Appl. No.: 21,134

[22] Filed: Feb. 23, 1993

[30] Foreign Application Priority Data

Feb. 25, 1992 [JP] Japan ..... 4-008312[U]

[51] Int. Cl.[5] ..... H01R 4/24

[52] U.S. Cl. ..... 439/407

[58] Field of Search ..... 439/389–425

[56] References Cited

U.S. PATENT DOCUMENTS 3,902,154 8/1975 McKee ..... 439/406
3,964,815 6/1976 McDonough ..... 439/406
4,940,425 7/1990 Hass et al. ..... 439/406

FOREIGN PATENT DOCUMENTS 54-132783 9/1979 Japan .
60-37814 11/1985 Japan .

OTHER PUBLICATIONS

U.S. Ser. No. 07/957,903 Filed in Oct. 1992 to M. Yamanoto.

*Primary Examiner*—Joseph H. McGlynn
*Attorney, Agent, or Firm*—Wigman, Cohen, Leitner & Myers

[57] ABSTRACT

In order to connect and couple a member to an insulated wire, a pressure connection terminal comprises a base, two side walls extending from the base, an electrically-connecting portion disposed at a first end portion of the terminal, a pressure connection blade which is disposed between the first and second end portions of the terminal and which is adapted to receive and strip off a corresponding insulating portion of the insulated wire, a first holder disposed near the second end portion for holding the insulated wire, and a second holder disposed between the first end portion and the pressure connection blade for holding the electric wire. Additionally, the pressure connection terminal further includes a first and second projections provided on the base respectively corresponding to the first and second holders, so as to secure the electric wire cooperatively therewith.

11 Claims, 4 Drawing Sheets

PRESSURE CONNECTION TERMINAL

TECHNICAL FIELD

The present invention relates to a pressure connection terminal having a pressure connection blade for electric connection.

BACKGROUND OF THE INVENTION

There is a known structure of a pressure connection terminal as shown in FIGS. 1–3 disclosed in the Utility Model Application for Publication No. (SHO)60-37814. The pressure connection terminal of this type has a pin-shape connecting portion 3 at its distal end and a pair of pressure connection blades 5*a*, 5*b* behind the connecting portion. In each of these connection blades 5*a*, 5*b*, upwardly-opening slots 7*a*, 7*b* are provided respectively for receiving an electric wire. In such a structure, when an insulated electric wire 9 is pressed into the respective slots 7*a*, 7*b* as shown in FIG. 2, the insulating portion 9*a* of the wire is stripped off at the sites corresponding to the connection blades 5*a*, 5*b*, then the conductive portion 9*b* of the wire comes in contact with these connection blades 5*a*, 5*b*. Accordingly, the connection between the pressure connection terminal 1 and insulated wire 9 requires no additional works for stripping off the insulating portion 9*a*, thus the workability can be markedly improved.

However, the coupling force between the pressure connection blades 5*a*, 5*b* and insulated wire 9 by the pressure connection terminal is not so strong that when the electric wire 9 is pulled in the direction of arrow P as shown in FIG. 2, the electric connection therebetween is likely to be broken.

Therefore, in order to avoid such a problem, a pressure connection terminal as shown in FIG. 4 is disclosed in the Utility Model Application Laid Open No. (SHO)54-132783. In the pressure connecting terminal, a holding portion 11 is further provided behind the pressure connection blades 5*a*, 5*b* to rigidly hold the insulated wire 9 by caulking the holding portion 11 toward the wire.

In the above described pressure connection terminal, the durability against the external force applied along the arrow P can be surely improved by the holding portion 11. Therefore, the coupling force between the terminal and insulated wire 9 is increased as compared with the structure shown in FIGS. 1–3 while the workability for the pressure connection terminal is kept excellent.

In this case, however, when external force in the direction of arrow Q is applied to the distal end of insulated wire 9 as shown in FIG. 5, the distal end is likely to be raised as designated by the dotted line in FIG. 5, resulting in disconnection.

SUMMARY OF THE INVENTION

In view of the above, an object of the present invention is to solve the aforementioned problems in the prior art through the provision of a pressure connection terminal which not only can present excellent workability but also can guarantee stable electric connection and mechanical coupling between an electric wire and the terminal.

The aforementioned object of the present invention is accomplished through the provision of a pressure connection terminal comprising a base, two side walls extending from the base, an electrically-connecting portion disposed at a first end portion of the terminal, a pressure connection blade disposed between the first and second end portions of the terminal, said pressure connection blade for receiving and stripping off a corresponding insulating portion of the insulated wire, a first holder disposed near the second end portion for holding the insulated wire, and a second holder disposed between the first end portion and the pressure connection blade for holding the electric wire.

In a preferred embodiment of the present invention, each of the first and second holders is formed by a pair of opposing portions extending from the respective side walls of the terminal so that the pair of opposing portions are caulked together. Further, the pressure connection terminal can comprise a first projection provided on the base of the terminal at a location opposing the first holder so as to secure the wire cooperatively with the first holder. Moreover, the pressure connection terminal can comprise a second projection provided on the base of the terminal at a location opposing the second holder so as to fix the electric wire cooperatively with the second holder.

These and other objects, features and advantages of the present invention will be more apparent from the following description of a couple of preferred embodiments, taken in conjunction with the accompanying drawings.

DETAILED DESCRIPTION OF THE PREFERRED EMBODIMENTS

A pressure connection terminal and the modifications thereof according to the present invention will be described hereinafter.

Figure 1:
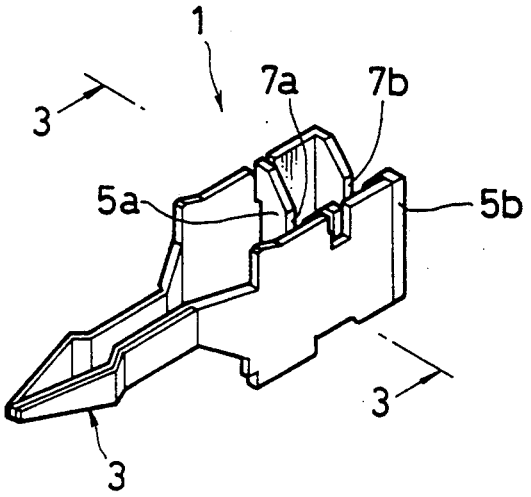
FIG. 1 PRIOR ART
FIG. 1 is a perspective view of an example relating to the prior art.
Figure 2:
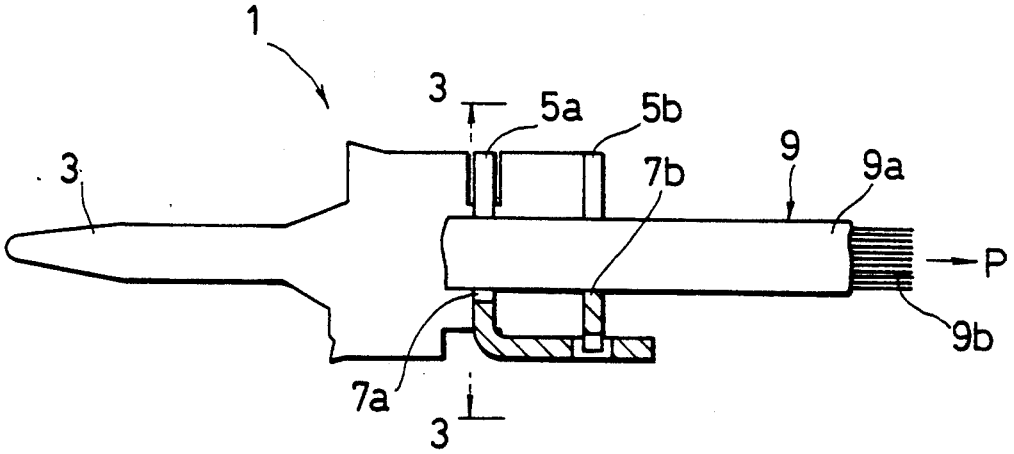
FIG. 2 PRIOR ART
FIG. 2 is a cross sectional view of the example shown in FIG. 1.
Figure 3:
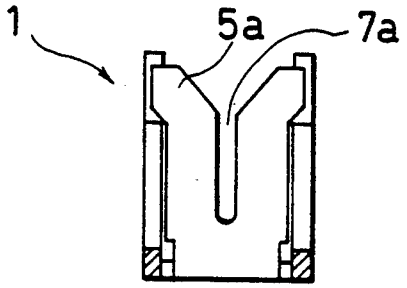
FIG. 3 PRIOR ART
FIG. 3 is a cross sectional view taken in a direction shown by arrows 3—3 in FIG. 1.
Figure 4:
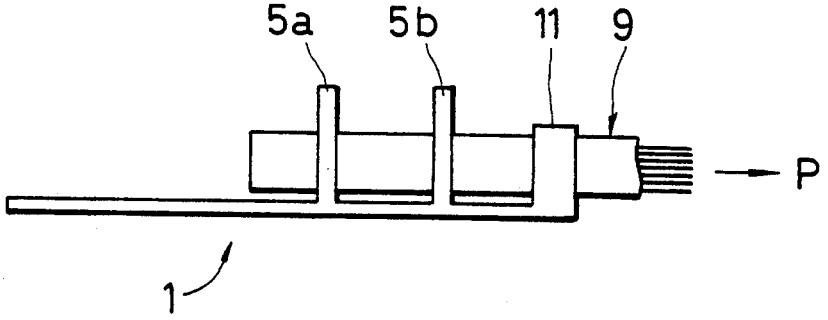
FIG. 4 PRIOR ART
FIG. 4 is a partly-cutaway side view of another example relating to the prior art.
Figure 5:
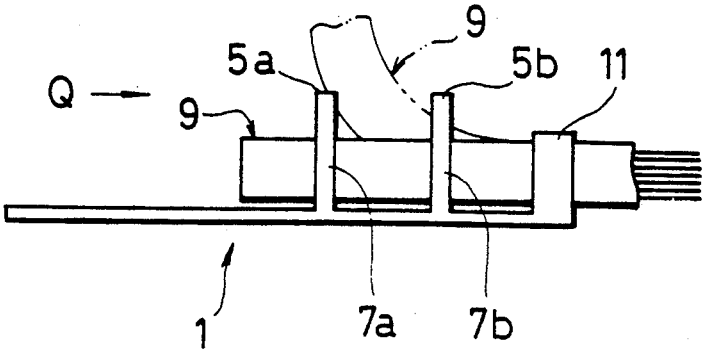
FIG. 5 PRIOR ART
FIG. 5 is a side view explaining the inconvenience lying in the example shown in FIG. 4.
Figure 6:
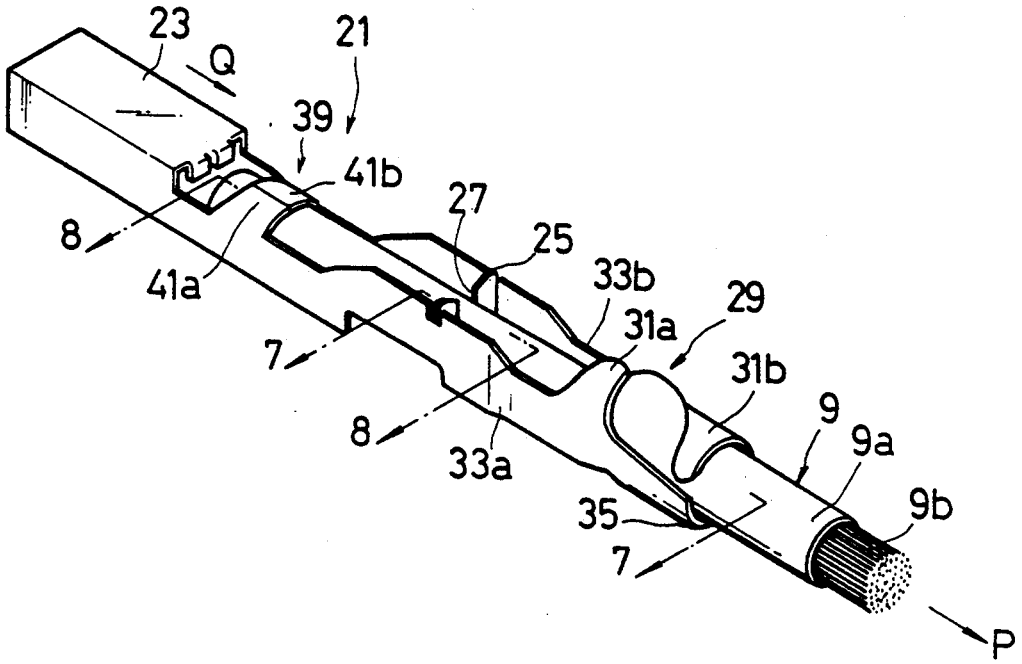
FIG. 6 is a perspective view of an embodiment according to the present invention.

FIG. 6 is a perspective view of an embodiment according to the present invention. In this case, the pressure connection terminal 21 is formed by press-molding with a conductive metal plate. The terminal 21 has an electrically-connecting portion 23 at its first end portion and a pressure connection blade 25 disposed between the electrically-connecting portion 23 and a second end portion of the terminal. Similarly to those in the prior art as described above, the pressure connection blade 25 is used for stripping off a corresponding insulating coat from an electric wire when the wire is pressed into the connection blades thereby to electrically connect the terminal and wire. Though the electrically-connecting portion 23 of this embodiment is of a so-called female type, it may be also of a male type. Moreover, the pressure connection blade 25 is provided with a slot 27 in which the electric wire is received.

Further provided behind the pressure connection blade 25 is a first holder 29 having two ears 31*a* and 31*b* for holding an electric wire by caulking these ears together toward the wire. These ears 31*a*, 31*b* are disposed at a predetermined interval along the longitudinal direction of the pressure connection terminal 21 so that one ear 31*a* extends from one side wall 33*a* of the terminal 21 while the other 31*b* from the other side wall 33*b*. Namely, an insulated wire 9 is held by crimping these ears 31*a* and 31*b* disposed between the pressure connection blade 25 and the second end portion of the terminal, particularly near the second end portion.

Figure 7:
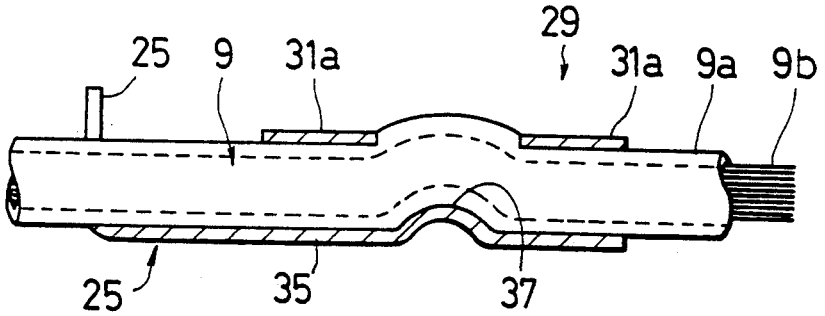
FIG. 7 is a cross sectional view taken along the line 7—7 in FIG. 6.

Moreover, as shown in FIG. 7 of a cross-section taken along the line 7—7 in FIG. 6, a projection 37 is provided in the base 35 of the pressure connection terminal 21 between the ears 31*a* and 31*b*. This structure defined by both the ears 31*a*, 31*b* and projection 37 works effectively to increase the contact friction of the wire 9 in movement along the longitudinal direction of the terminal 21.

Figure 8:
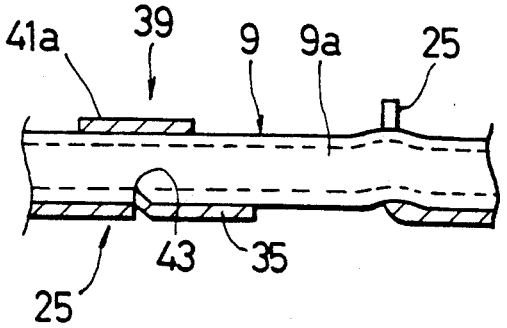
FIG. 8 is a cross sectional view taken along the line 8—8 in FIG. 6.

This embodiment further includes a second holder 39 for holding the wire 9 between the electrically-connecting portion 23 and the pressure connection blade 25 as shown in FIG. 6. Similarly, the second holder 39 has two ears 41*a*, 41*b* opposing each other and extending from the side walls 33*a*, 33*b* respectively so as to hold the wire 9 by crimping these ears together. Moreover, a sharp projection 43 is raised from the base 35 at a corresponding location to ears 41*a*, 41*b* as shown in a cross-section of FIG. 8 taken along the line 8—8 in FIG. 6, so that the projection 43 bites into the insulating portion 9*a* of wire 9 when these ears are caulked together against the wire.

Next, the operation for connecting and coupling the pressure connection terminal 21 and insulated wire 9 will be explained.

In the beginning, all of the respective ears 31*a*, 31*b*, 41*a*, 41*b* of the first and second holders 29, 39 stand upwardly along the corresponding side walls 33*a* and 33*b*. This time, the projections 37 and 43 are already formed. In such a state, one end portion of the insulated wire 9 is placed in the pressure connection terminal 21 so that the distal end of the wire is located at the second holder 39. At the same time, the insulated wire 9 is pressed into the slot 27, and the ears 31*a*, 31*b*, 41*a*, 41*b* are bent toward the wire, respectively. Since these can be processed simultaneously, the operation requires no additional time or steps as compared with the prior art. When the coupling between the pressure connection terminal 21 and the insulated wire 9 is completed, the insulating portion 9*a* of the wire corresponding to the pressure connection blade 25 is automatically stripped off so that the conductive portion 9*b* connects electrically with the terminal 21.

In this case, the wire 9 is held by the first holder 29 at the second end portion as well as by the second holder 39 between the electrically-connecting portion 23 and the pressure connection blade 25. Accordingly, the coupling force between the pressure connection terminal 21 and insulated wire 9 can be increased by these first and second holders 29 and 39 while keeping the above advantages of the prior art. In addition, since the projection 37 around the first holder 29 pushes upwardly the wire 9 between the ears 31*a*, 31*b* as shown in FIG. 7, the contact pressure of the insulated wire 9 against the ears 31*a*, 31*b* is elevated. Therefore, the coupling force between the terminal 21 and wire 9 is more enhanced.

Furthermore, since the projection 43 bites into the insulating portion 9*a* of the wire 9 when the ears 41*a*, 41*b* of the second holder 39 are crimped together, the coupling force can be increased also by the effect of the projection 43.

Therefore, according to the structure of this embodiment, even if pulling force in the direction of arrow P is applied to the wire 9 as shown in FIG. 6, the wire 9 can be rigidly held by the first holder 29. Thus, the electric connection can be kept in a desired state without any influence by such pulling force. Also in the case where external force along the arrow Q is applied to the distal end of wire 9, all the force is received by the second holder 39, thereby to prevent the distortion or disconnection of the wire as described in the above prior art.

Figure 9:
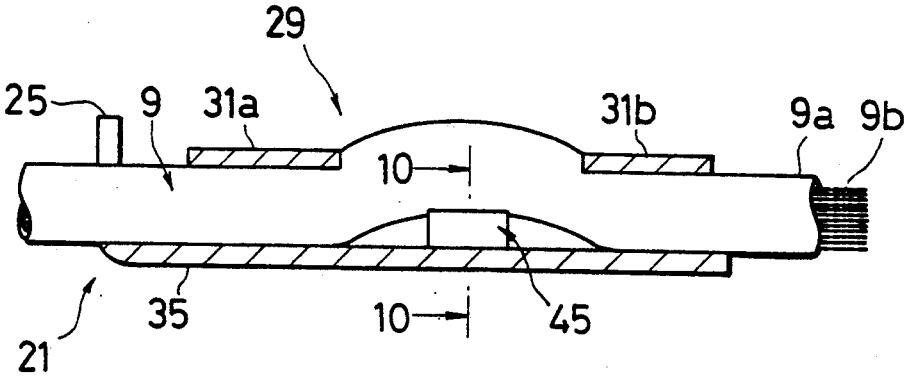
FIG. 9 is a cross sectional view showing an important portion of a modified example relating to the embodiment shown in FIG. 6.
Figure 10:
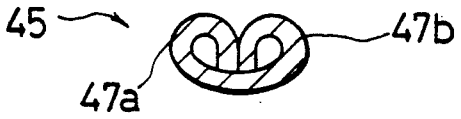
FIG. 10 is a cross sectional view taken along the line 10—10 in FIG. 9.
Figure 11:
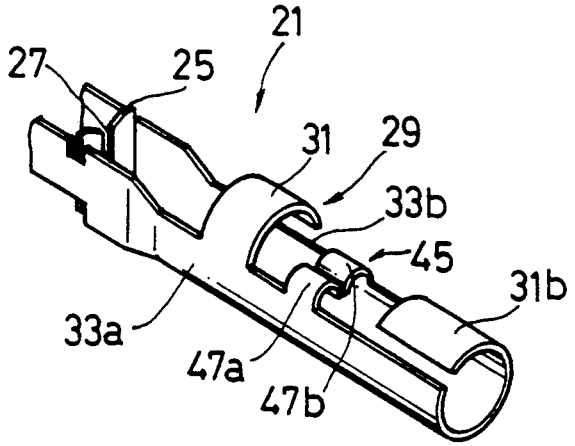
FIG. 11 is a perspective view of another modified example relating to the embodiment shown in FIG. 6.

FIG. 9 shows a modified example of the embodiment in FIG. 7, in which the projection 37 of the first embodiment is changed into a new projection 45. Similarly to the first embodiment in FIG. 7, the projection 45 is disposed on the base between the ears 31*a*, 31*b*. However, the new projection has a cross-section as shown in FIG. 10 taken along the line 10—10 in FIG. 9 to be formed by inwardly bending respective parts 47*a*, 47*b* of the side walls 33*a*, 33*b* toward the base as shown in FIG. 11. Accordingly, such a projection 45 can also lift up the wire 9 between the ears 31*a*, 31*b*. The increase of contact pressure between the insulating portion 9*a* of the wire and ears 31*a*, 31*b* by the projection 45 becomes substantially equal to the case shown in FIG. 7.

Various modifications will become possible for those skilled in the art after receiving the teachings of the present disclosure without departing from the scope thereof.

What is claimed is:

1. A pressure connection terminal for connecting and coupling a member to an insulated wire, said terminal comprising:

a base;

two side walls extending from the base;

an electrically connecting portion disposed at a first end portion of the terminal;

a pressure connection blade disposed between the electrically connecting portion and a second end portion of the terminal, said pressure connection blade for receiving and stripping off a corresponding insulating portion of the insulated wire;

a first holder disposed near the second end portion for holding the insulated wire; and a second holder disposed between the first end portion and the pressure connection blade for holding the electric wire;

wherein each of the first and second holders is formed by crimping together a pair of opposing portions extending from the respective side walls of the terminal and wherein the pair of opposing portions for constructing the first holder are spaced apart from each other along the longitudinal direction of the terminal at a predetermined interval, further comprising a first projection provided on the base of the terminal at a location opposing the first holder so as to secure the wire cooperatively with the first holder.

2. The pressure connection terminal according to claim 1, further comprising a second projection provided on the base of the terminal at a location opposing the second holder so as to fix the electric wire cooperatively with the second holder.

3. The pressure connection terminal according to claim 1, wherein the pressure connection blade defines a slot for receiving the wire therein.

4. The pressure connection terminal according to claim 1, wherein the first projection is disposed on the base at a location opposing the area interposed between the pair of opposing portions for constructing the first holder.

5. The pressure connection terminal according to claim 4, wherein the first projection is formed by protruding a portion of the base toward the corresponding insulating portion of the wire.

6. The pressure connection terminal according to claim 4, wherein the first projection is formed by being corresponding parts of the side walls and bent inwardly toward the base respectively.

7. The pressure connection terminal according to claim 4, further comprising a second projection provided on the base of the terminal at a location opposing the second holder so as to fix the electric wire cooperatively with the second holder.

8. The pressure connection terminal according to claim 7, wherein the pressure connection blade defines a slot for receiving the wire therein.

9. A pressure connection terminal for connecting and coupling a member to an insulated wire, said terminal comprising:

a base;

two side walls extending from the base;

an electrically connecting portion disposed at a first end portion of the terminal;

a pressure connection blade disposed between the electrically connecting portion and a second end portion of the terminal, said pressure connection blade for receiving and stripping off a corresponding insulating portion of the insulated wire;

a first holder disposed near the second end portion for holding the insulated wire;

a second holder disposed between the first end portion and the pressure connection blade for holding the electric wire; and a projection provided on the base of the terminal at a location opposing the second holder so as to fix the electric wire cooperatively with the second holder.

10. The pressure connection terminal according to claim 9, wherein the second projection is formed by cutting and raising a portion of the base so that the projection bites into the insulating portion of the wire when the wire is held by the second holder.

11. A pressure connection terminal for connecting and coupling a member to an insulated wire, said terminal comprising:

a base;

two side walls extending from the base;

an electrically connecting portion disposed at a first end portion of the terminal;

a pressure connection blade disposed between the electrically connecting portion and a second end portion of the terminal, said pressure connection blade for receiving and stripping off a corresponding insulating portion of the insulated wire;

a first holder disposed near the second end portion for holding the insulated wire; and a second holder disposed between the first end portion and the pressure connection blade for holding the electric wire;

wherein each of the first and second holders is formed by crimping together a pair of opposing portions extending from the respective side walls of the terminal, further comprising a projection provided on the base of the terminal at a location opposing the second holder so as to fix the electric wire cooperatively with the second holder.

* * * * *